United States Patent [19]

Williams, Sr.

[11] Patent Number: 4,967,426

[45] Date of Patent: Nov. 6, 1990

[54] TOILET SEAT AND COVER HOLDER

[76] Inventor: Ricky A. Williams, Sr., 7135 Robin Rd., New Port Rickey, Fla. 34654-4742

[21] Appl. No.: 396,293

[22] Filed: Aug. 21, 1989

[51] Int. Cl.[5] ..... A47K 17/00

[52] U.S. Cl. ..... 4/661

[58] Field of Search ..... 4/235, 251, 253, 661, 4/234, 237, 239, 248

[56] References Cited

U.S. PATENT DOCUMENTS

| | | | |
|---|---|---|---|
| 542,633 | 7/1895 | Emery | 4/235 |
| 1,599,475 | 9/1926 | Kozminski | 4/248 |
| 2,918,318 | 12/1959 | Sacharski | 292/87 |
| 4,638,515 | 1/1987 | Caputo et al. | 4/661 |
| 4,707,870 | 11/1987 | Glassco | 4/661 |
| 4,839,928 | 6/1989 | Probasco | 4/661 X |

*Primary Examiner*—Charles E. Phillips

*Attorney, Agent, or Firm*—T. M. Gernstein

[57] ABSTRACT

A toilet seat and cover holding unit includes a base that can be placed on a toilet tank top surface and moved as necessary, and also includes an arm that has a multiplicity of angles and contacts the toilet seat and cover to keep those elements in an upright, bowl uncovering position.

6 Claims, 2 Drawing Sheets

TOILET SEAT AND COVER HOLDER

FIELD OF THE INVENTION

The present invention relates to the general art of plumbing fixtures, and to the particular field of water closets.

BACKGROUND OF THE INVENTION

Many toilet units include a bowl which has a seat and a cover mounted thereon by means of a hinge element. The seat and cover are moved between a horizontal bowl-covering position and a vertically upright, bowl-uncovering position.

A problem with many toilet units, especially older ones, is that the seat and cover may not remain upright because the hinge element has become worn. This has caused problems in many areas, especially in hospitals or nursing homes where a patient may not be capable of lifting the seat himself. As such, the art has several examples of devices that are intended to hold a toilet seat and cover in an upright, bowl-uncovering orientation. One example of such proposals is found in U.S. Pat. No. 4,707,870 which discloses a hook-like bracket that is mounted on the toilet and secures the cover or the seat of the toilet unit to the tank in an upright orientation.

While somewhat successful in achieving the object of securing a cover or a seat in an upright position, such devices still have several drawbacks. Many of these drawbacks are caused by the fixed nature of the device. That is, the holding device remains in place, even when the seat and/or the cover is in the bowl-closing position. Such fixed nature may create problems in cleaning both of the toilet itself and of the device. The toilet may also tend to become discolored where the device is attached thereto.

Such fixed nature of the mounting also creates problems with the opening and closing the seat and the cover. The seat and/or the cover must be forced past the holding device when the cover is being opened, yet the device must be designed to permit that cover to be moved therepast to close the unit. The device must be specially designed, and this still may cause problems with older or incapacitated patients. This is especially so if special manipulation is required to move the cover and/or seat past the device.

Therefore, there is a need for a holding device which will hold a toilet seat and/or a toilet cover in an upright, bowl-uncovering position yet can be easily moved to permit cleaning of the toilet unit and the device and to permit the cover and/or the seat to be closed in and easy manner when necessary.

OBJECTS OF THE INVENTION

It is a main object of the invention to provide a holding device which will hold a toilet seat and/or a toilet cover in an upright, bowl-uncovering position and yet is not affixed to the bowl.

It is another object of the invention to provide a holding device which will hold a toilet seat and/or a toilet cover in an upright, bowl-uncovering position yet can be easily moved to permit cleaning of the toilet unit and the device.

It is another object of the invention to provide a holding device which will hold a toilet seat and/or a toilet cover in an upright, bowl-uncovering position yet can be easily moved to permit cleaning of the toilet unit and the device and can be easily moved to permit cleaning of the toilet unit and the device.

SUMMARY OF THE INVENTION

These, and other, objects are achieved by a holder unit which is shaped to re-orient the closing forces associated with an upright toilet seat and cover so that a simple movable base can be used to keep such seat and/or cover in an open position.

The holder includes an arm that has a plurality of angles defined therein so that the closing force acts through several angles before it is applied to the base. The base is weighted so that the frictional forces between such base and a toilet tank top surface are sufficient to resist such closing forces.

In this manner, the holding device can be easily moved for cleaning either of that device or of the toilet unit tank, and can also be manipulated to permit the seat and/or the cover to be closed when desired.

DETAILED DESCRIPTION OF THE PREFERRED EMBODIMENT OF THE INVENTION

Figure 1:
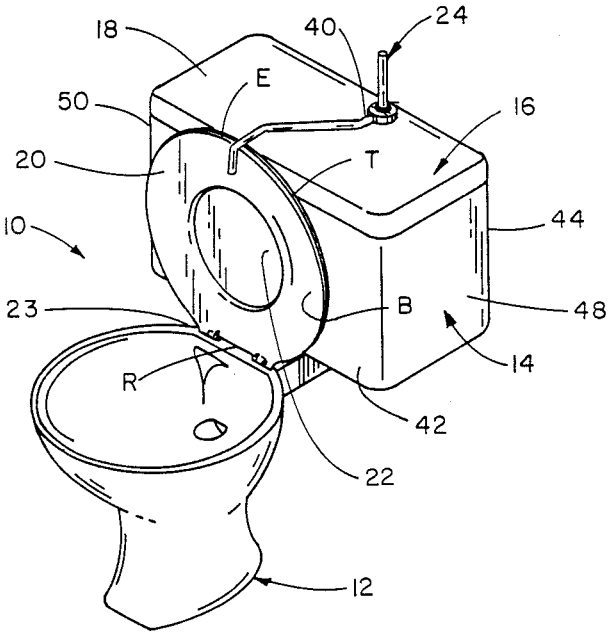
FIG. 1 is a perspective view of a toilet unit with a holding device mounted on the tank portion and holding a seat and a cover in a bowl-uncovering position.

Shown in FIG. 1 is a toilet unit 10 which includes a bowl portion 12 and a tank portion 14 which includes a top 16 and which contains the water used in the operation on the toilet unit. The tank top includes a top surface 18 and removably covers the tank.

The toilet unit also includes a seat 20 and a cover 22 which are attached to the bowl by a hinge unit 24 to move between a bowl-covering horizontal position to the bowl-uncovering upright position shown in FIG. 1. The seat includes a bottom surface B that contacts the bowl in the closed position, and the cover has a top surface T that is located adjacent to the tank in the open position, and the combination has a thickness that is measured between the top surface T and the bottom surface B, with each element having a thickness as measured between a top and a bottom surface. The seat and cover include a forward end E that is located adjacent to the tank top 16 in the open position and a rear end R connected to the hinge unit 23.

As was discussed above, should the hinge unit 23 become worn, the seat and/or the cover may tend to fall from the FIG. 1 open position back to the bowl-covering position. Not only is this inconvenient, it may be dangerous to an incapacitated patient.

Therefore, the present invention includes a holding unit 24 that maintains the seat and cover in an upright position, yet does so without being connected to the toilet unit in the manner of prior devices, and thus is free to move for cleaning or for freeing the seat and cover to move back into a bowl-covering position.

Figure 2:
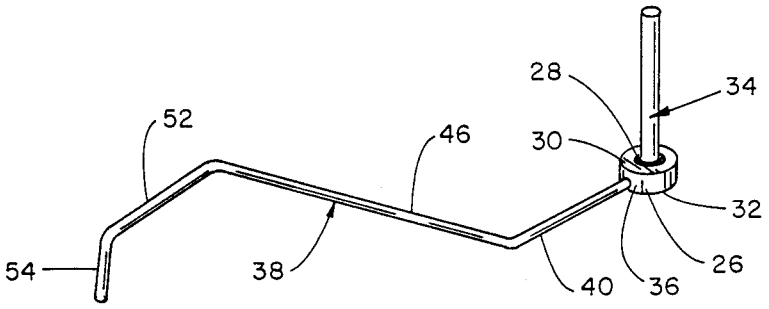
FIG. 2 is a perspective view of the holding device of the present invention.

The holding device 24 is best shown in FIG. 2 as including a circular base 26 that is in the form of a cylinder and includes a weight 28 in the center thereof. The base has a top surface 30 and a bottom surface 32 which contacts the top surface 18 of the tank. The bottom surface 32 preferably has a friction-improving anti-slip characteristic, such as roughening or the like so the base will not move easily from one place to another on the tank top.

A handle 34 extends vertically upwards from the base, and is used to grasp the unit 24, as well as to add weight thereto. In the preferred embodiment, the weight 28 has a weight that exceeds the combined weight of the handle and the base to further improve the anti-slip characteristics of the device. Attached to wall 36 of the base is an arm 38. The arm is attached to the base to extend horizontally and parallel to the top surface 18 of the tank when the unit 24 is in place. The arm attaches the cover and seat to the holding unit in a manner such that the forces tending to drop the cover and seat from the open, FIG. 1, condition to a closed condition.

The arm includes a plurality of angles whereby the forces exerted thereon in the horizontal plane are re-oriented. The horizontal forces resulting from the tendency of the seat and cover to fall closed are thus broken down so that only a component of such forces is applied to the base. In this manner, the base need not resist the total closing force, but only a part thereof. Furthermore, the angular offset positioning of the base with respect to the arm 38 permits that base to be located beside the seat and cover forward end thereby moving the holding unit into a more convenient location on the tank.

As is best shown in FIG. 2, the arm 38 includes a first section 40 connected to the base at one end thereof and extending in a horizontal plane parallel to the tank top surface 18 from the base toward the seat and cover for a distance just over half the width of the tank as measured from the front surface 42 thereof to the rear surface 44 thereof. A second section 46 is connected at one end thereof to the other end of the first section and extends at an oblique angle with respect to the tank sides 48 and 50 and with respect to the first section 40. The second section 46 has a projected length that exceeds half the thickness of the tank. By projected length, it is meant that length of the arm section projected onto the plane containing side 48 or onto the plane containing side 50 since the arm second section is obliquely oriented with respect to such planes.

The arm 38 further includes a third section 52 is connected at one end thereof to the other end of the second section and extends in the horizontal plane along with the first and second sections. The third section extends parallel to the first section and extends past the front surface 42 of the tank a distance that is slightly greater than the thickness of the toilet seat and cover combination.

A fourth arm section 54 extends in a vertical plane perpendicular to the plane containing the first, second and third arm sections and is connected at one end thereof to another end of the third arm section 52. The fourth arm section can be vertically oriented or can extend at an angle with respect to the vertical so as to securely contact a toilet seat and cover combination that has its forward end E located above the plane containing the tank top surface 18. The arm can also accommodate such a situation by having the second and third arm sections angled upwards out of the plane containing the first arm section.

Figure 5:
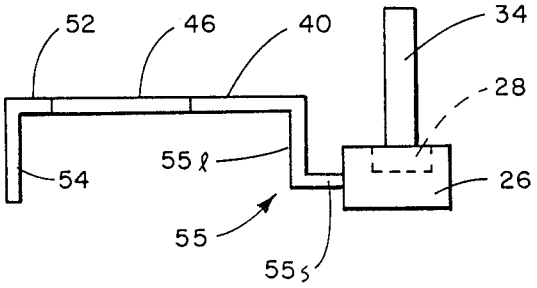
FIG. 5 is a side elevational view of an alternative form of the device used in conjunction with a toilet seat and cover that overlap the top of the tank.

As shown in FIG. 5, a fifth section 55 can also be added to the arm to accommodate such an overlap situation. The fifth section is inserted between the first section 40 and the base 26, and is L-shaped with the short leg 55*s* of the L connected to the base, and the long leg 55*l* connected to the first section at the end of that first section that is shown connected to the base in FIG. 1. This L-shaped fifth section is vertically oriented to displace the arm upwards a distance sufficient to accommodate the overlap between the top of toilet seat and the top of the tank.

As can be seen from the foregoing, the holding unit 24 holds the toilet seat and cover in the FIG. 1 open vertical position by having the arm fourth section engage the seat rear surface B and the base 26 resting on the tank top surface 18. The friction forces existing between the base and the tank top surface will be sufficient to hold the seat and cover in the open position since the forces tending to close the seat and cover are re-distributed through several angles and planes before being applied to the base.

The seat and cover are released by simply turning the holding unit clockwise in FIG. 2 to move the arm fourth section away from engagement with the seat. The unit can also be simply moved. Such action can be carried out by most patients even if they are otherwise handicapped.

Figure 3:
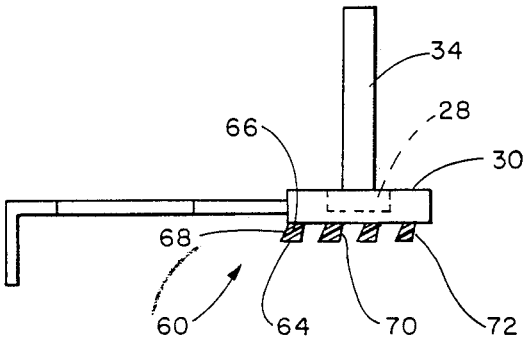
FIG. 3 is a side elevational view of an alternative form of the holding device.
Figure 4:
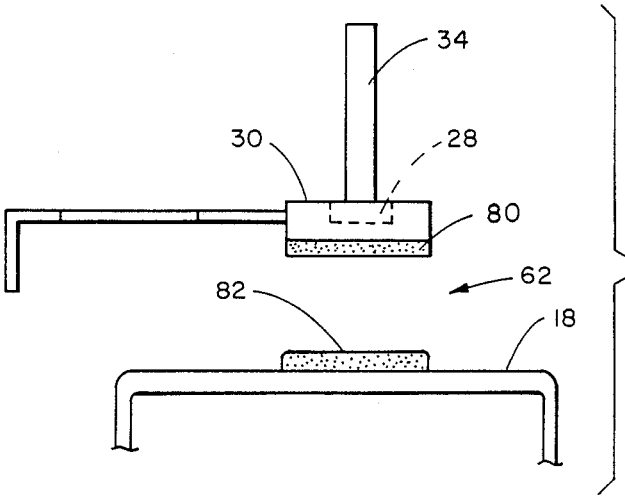
FIG. 4 is a side elevational view of an alternative form of the device in conjunction with a portion of a tank of a toilet unit.

The unit 24 can also include further anti-slip means on the base bottom surface 32 to further increase the frictional resistance to movement of that base. Such further anti-slip means is shown in FIGS. 3 and 4, and includes a multiplicity of rubber feet 60 shown in FIG. 3 and a hook-and-loop fastening system 62 shown in FIG. 4.

Each foot 60 is in the shape of a truncated triangle in cross section and thus includes a base 64 which rests on the tank top surface, and a top 66 fixed to the bottom surface of the base. These elements are connected together by a hypotenuse 68 and a vertical leg 70. A forward apex 72 is formed by the intersection of the hypotenuse and the base and this apex is located towards the front of the base with respect to the front of the tank. The bases of all of the feet are co-planar.

The hook-and-loop system 62 includes a first element 80 mounted on the bottom of the base and a second element 82 fixed to the tank top surface 18. The holding unit is moved by detaching the base from the second element 82 and rotating the unit as required.

It is understood that while certain forms of the present invention have been illustrated and described herein, it is not to be limited to the specific forms or arrangements of parts described and shown.

I claim:

1. A combination comprising:

(A) a toilet seat unit which includes (1) a bowl, (2) a seat and a cover connected to said bowl to cover same, said toilet seat and cover each having a top surface and a bottom surface which will be located adjacent to said bowl when said seat and cover are in a horizontal orientation covering said bowl and a thickness as measured between said top and bottom surfaces, (3) a tank having a top located adjacent to said bowl, said tank top having a top surface, a front edge, a rear edge, and parallel side edges, and (4) hinge means on said bowl connecting said seat and cover to said bowl to move from said horizontal bowl-covering orientation into an upright, essentially vertical orientation adjacent to said tank with a portion of said seat and cover being located adjacent to said tank top front edge; and (B) a unitary, one-piece toilet seat and cover holding unit which includes (1) a base on said tank top surface spaced from said front edge and including weight means therein, (2) a handle extending essentially vertically upward from said base, (3) an arm extending horizontally outward from said base toward said tank top front edge and including (a) a first section connected at one end thereof to said base and extending horizontally and essentially parallel to said tank top side edges, (b) a second section connected at one end thereof to another end of said first section and extending obliquely to all of said tank top edges and toward said tank top front edge, (c) a third section connected at one end thereof to another end of said second section and extending horizontally and parallel to said first section and spaced therefrom toward one of said tank top side edges and extending past said tank top front edge a distance slightly greater than the combined thickness of said toilet seat and cover, and (d) a fourth section connected at one end thereof to another end of said third section and extending vertically downward toward said toilet bowl.

2. The combination defined in claim 1 further including anti-slip means on said base and engaging said toilet tank top.

3. The combination defined in claim 2 wherein said base weight means has a weight which exceeds the combined weights of said handle and said base.

4. The combination defined in claim 3 wherein said anti-slip means includes a multiplicity of truncated right triangular rubber feet, each having a base with all of said feet bases being co-planar, and each having a hypotenuse facing said tank top front edge.

5. The combination defined in claim 2 wherein said anti-slip means includes a hook-and-loop fastener unit element on said base and a second hook-and-loop fastener unit element on said tank top.

6. A combination comprising:

(A) a toilet seat unit which includes (1) a bowl, (2) a seat and a cover connected to said bowl to cover same, said toilet seat and cover each having a top surface and a bottom surface which will be located adjacent to said bowl when said seat and cover are in a horizontal orientation covering said bowl and a thickness as measured between said top and bottom surfaces, (3) a tank having a top located adjacent to said bowl, said tank top having a top surface, a front edge, a rear edge, and parallel side edges, and (4) hinge means on said bowl connecting said seat and cover to said bowl to move from said horizontal bowl-covering orientation into an upright, essentially vertical orientation adjacent to said tank with a portion of said seat and cover being located adjacent to said tank top front edge; and (B) a unitary, one-piece toilet seat and cover holding unit which includes (1) a base on said tank top surface spaced from said front edge and including weight means therein, (2) a handle extending essentially vertically upward from said base, (3) an arm extending outward from said base toward said tank top front edge and including (a) a first L-shaped section having a short leg connected at one end thereof to said base and extending horizontally outward from said base and having a long leg connected to said short leg and extending vertically upward from said short leg, (b) a first section connected at one end thereof to said long leg and extending horizontally and essentially parallel to said tank top side edges, (c) a second section connected at one end thereof to another end of said first section and extending obliquely to all of said tank top edges and toward said tank top front edge, (d) a third section connected at one end thereof to another end of said second section and extending horizontally and parallel to said first section and spaced therefrom toward one of said tank top side edges and extending past said tank top front edge a distance slightly greater than the combined thickness of said toilet seat and cover, and (e) a fourth section connected at one end thereof to another end of said third section and extending vertically downward toward said toilet bowl.

* * * * *